US010551785B2

(12) United States Patent
Fushiya et al.

(10) Patent No.: US 10,551,785 B2
(45) Date of Patent: Feb. 4, 2020

(54) IMAGE FORMING APPARATUS AND IMAGE FORMING APPARATUS CONTROL PROGRAM

(71) Applicant: KONICA MINOLTA, INC., Chiyoda-ku, Tokyo (JP)

(72) Inventors: Kengo Fushiya, Toyokawa (JP); Hideaki Tanaka, Hussa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/258,397

(22) Filed: Jan. 25, 2019

(65) Prior Publication Data

US 2019/0243298 A1 Aug. 8, 2019

(30) Foreign Application Priority Data

Feb. 7, 2018 (JP) ..... 2018-020551

(51) Int. Cl.

| | |
|---|---|
| ***G03G 15/08*** | (2006.01) |
| ***G03G 21/00*** | (2006.01) |
| ***G03G 15/02*** | (2006.01) |
| ***G03G 15/00*** | (2006.01) |

(52) U.S. Cl.

CPC ..... *G03G 21/0035* (2013.01); *G03G 15/0225* (2013.01); *G03G 15/0258* (2013.01); *G03G 15/5058* (2013.01); *G03G 21/0094* (2013.01)

(58) Field of Classification Search

CPC ..... G03G 15/0225; G03G 15/0258; G03G 15/0844; G03G 15/5054; G03G 15/5058; G03G 21/0035; G03G 21/0094; G03G 21/20

See application file for complete search history.

(56) References Cited

U.S. PATENT DOCUMENTS

| | | | | |
|---|---|---|---|---|
| 2010/0239969 | A1* | 9/2010 | Owada | G03G 9/0808 430/108.2 |
| 2015/0261129 | A1* | 9/2015 | Hayashi | G03G 15/065 399/55 |
| 2016/0320742 | A1 | 11/2016 | Ishida et al. | |
| 2017/0038720 | A1* | 2/2017 | Hirai | G03G 15/5058 |
| 2018/0299810 | A1* | 10/2018 | Miura | G03G 15/50 |
| 2019/0101844 | A1* | 4/2019 | Mochizuki | G03G 15/081 |

FOREIGN PATENT DOCUMENTS

| | | |
|---|---|---|
| JP | 2014211471 A | 11/2014 |
| JP | 2016212175 A | 12/2016 |

* cited by examiner

*Primary Examiner* — Sophia S Chen
(74) *Attorney, Agent, or Firm* — Holtz, Holtz & Volek PC

(57) ABSTRACT

An image forming apparatus includes: an image carrier to which a lubricant is applied; a developing device that develops an electrostatic latent image carried on the image carrier with toner, and includes a casing accommodating a toner-containing developer and a developing sleeve supplying the image carrier with the toner contained in the developer accommodated in the casing; and a hardware processor that detects information indicating a state of lubricant adhesion to the developing sleeve, and performs, based on a result of the detection by the hardware processor, a lubricant removing operation as an operation for removing the lubricant adhering to the developing sleeve.

11 Claims, 10 Drawing Sheets

IMAGE FORMING APPARATUS AND IMAGE FORMING APPARATUS CONTROL PROGRAM

The entire disclosure of Japanese patent Application No. 2018-020551, filed on Feb. 7, 2018, is incorporated herein by reference in its entirety.

BACKGROUND

Technological Field

The present invention relates to an image forming apparatus and an image forming apparatus control program. More specifically, the present invention relates to an image forming apparatus provided with a photoreceptor to which a lubricant is applied and an image forming apparatus control program.

Description of the Related Art

Electrophotographic image forming apparatuses include, for example, facsimile machines, copiers, printers, multi function peripherals (MFPs) having a scanner function, a facsimile function, a copy function, a function as a printer, a data communication function, and a server function, and the like.

In general, an electrophotographic image forming apparatus develops an electrostatic latent image formed on an image carrier by using a developing device to form a toner image and transfers the toner image to a sheet. Then, the apparatus forms an image on the sheet by fixing the toner image on the sheet with a fixer. In addition, some image forming apparatuses develop an electrostatic latent image on the surface of a photoreceptor by using a developing device to form a toner image, transfer the toner image to an intermediate transfer belt by using a primary transfer roller, and secondarily transfer the toner image on the intermediate transfer belt to a sheet by using a secondary transfer roller. In this case, the photoreceptor and the intermediate transfer belt serve as image carriers.

Known for cleaning performance and toner releasability improvement is an image forming apparatus in which a lubricant such as zinc stearate is applied to an image carrier. In a case where an extra lubricant is applied to the image carrier in this type of image forming apparatus, the magnetic brush of the toner that is formed on the peripheral surface of a developing roller of a developing device may abut against the image carrier, bonding may occur between the lubricant and the toner, and the lubricant may be recovered in the developing device. Once the lubricant is recovered in the developing device, an image forming operation that is performed by the image forming apparatus may be adversely affected.

The related art provides techniques for preventing lubricant mixing into a developing device and for removing a lubricant mixed in a developing device. Disclosed in JP 2014-211471 A is an image forming apparatus provided with a lubricant recoverer facing a developing roller and recovering a lubricant on the developing roller. In addition, disclosed in JP 2016-212175 A is an image forming apparatus provided with a lubricant remover disposed on the downstream side of a cleaner and the upstream side of a developer in the rotational direction of a photoreceptor and removing a lubricant adhering to the surface of the photoreceptor.

However, in the related art, it is unknown why lubricant mixing into the developing device adversely affects an image forming operation of the image forming apparatus. For this reason, it has been impossible to effectively deter adverse effects on image forming operations of image forming apparatuses.

SUMMARY

The present invention is intended to solve the above problems, and an object of the present invention is to provide an image forming apparatus and an image forming apparatus control program with which an adverse effect on an image forming operation can be effectively deterred.

To achieve the abovementioned object, according to an aspect of the present invention, an image forming apparatus reflecting one aspect of the present invention comprises: an image carrier to which a lubricant is applied; a developing device that develops an electrostatic latent image carried on the image carrier with toner, and includes a casing accommodating a toner-containing developer and a developing sleeve supplying the image carrier with the toner contained in the developer accommodated in the casing; and a hardware processor that detects information indicating a state of lubricant adhesion to the developing sleeve, and performs, based on a result of the detection by the hardware processor, a lubricant removing operation as an operation for removing the lubricant adhering to the developing sleeve.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

In the following embodiment, a case where an image forming apparatus is an MFP will be described. The image forming apparatus may also be a facsimile machine, a copier, a printer, or the like instead of the MFP.

[Configuration of Image Forming Apparatus]

The configuration of an image forming apparatus 1 according to the present embodiment will be described first.

Figure 1:
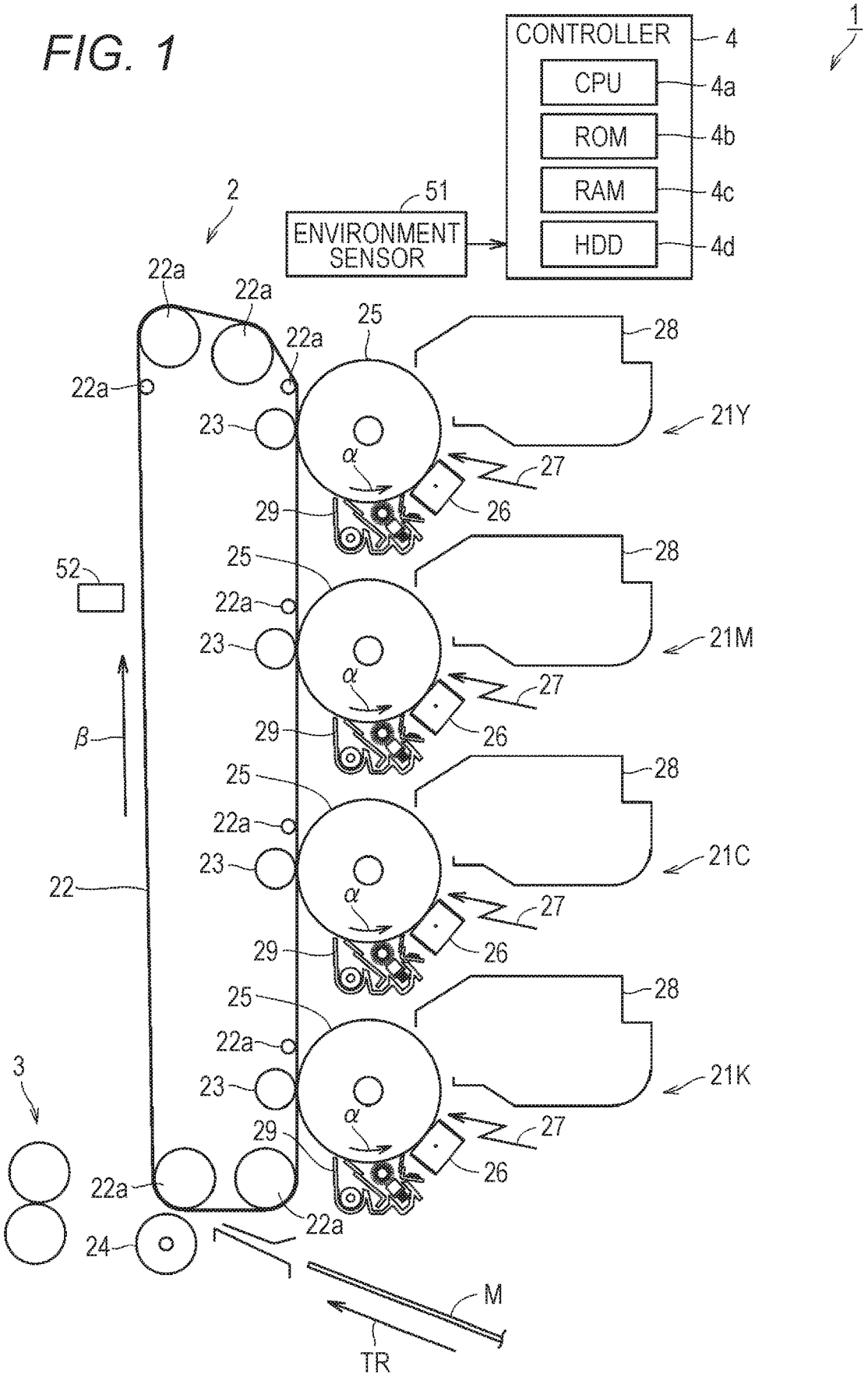
FIG. 1 is a cross-sectional view illustrating the configuration of an image forming apparatus according to an embodiment of the present invention.

FIG. 1 is a cross-sectional view illustrating the configuration of the image forming apparatus 1 according to an embodiment of the present invention.

Referring to FIG. 1, the image forming apparatus 1 according to the present embodiment is an MFP and mainly includes a toner image former 2 and a fixing device 3.

The toner image former 2 synthesizes images having the four colors of yellow (Y), magenta (M), cyan (C), and black (K) in a so-called tandem manner to form a toner image on a sheet. The toner image former 2 includes image forming units 21Y, 21M, 21C, and 21K (hereinafter, any one of the image forming units will be referred to as an image forming unit 21 in some cases) for the colors of Y, M, C, and K, respectively, an intermediate transfer belt 22, a primary transfer roller 23 for each of the colors of Y, M, C, and K, and a secondary transfer roller 24.

The image forming unit 21 for each of the colors of Y, M, C, and K includes, for example, a photoreceptor 25 (an example of an image carrier), a charging device 26, an exposure device 27, a developing device 28, and a cleaning device 29. The photoreceptor 25 is rotationally driven in the direction that is indicated by an arrow α in FIG. 1. The charging device 26, the exposure device 27, the developing device 28, and the cleaning device 29 are provided around the photoreceptor 25. The charging device 26 is provided in proximity to the photoreceptor 25. The exposure device 27 is provided on the right side of the photoreceptor 25.

The intermediate transfer belt 22 is provided on the left side of the image forming unit 21 for each of the colors of Y, M, C, and K. The intermediate transfer belt 22 is annular and is laid across a plurality of rotating rollers 22*a*. The intermediate transfer belt 22 is rotationally driven in the direction that is indicated by an arrow β in FIG. 1. The primary transfer rollers 23 respectively face the photoreceptors 25 across the intermediate transfer belt 22. The secondary transfer roller 24 is in contact with the intermediate transfer belt 22 on a transport route TR.

The fixing device 3 fixes the toner image on the sheet by transporting the toner image-carrying sheet along the transport route TR while gripping the sheet.

The image forming apparatus 1 charges the surface of the photoreceptor 25 with the charging device 26 by rotating the photoreceptor 25. The image forming apparatus 1 forms an electrostatic latent image on the surface of the photoreceptor 25 by performing exposure in accordance with image formation information with the exposure device 27 with respect to the charged surface of the photoreceptor 25. A lubricant is applied to the surface of the photoreceptor 25.

Next, the image forming apparatus 1 forms the toner image on the surface of the photoreceptor 25 by supplying toner from the developing device 28 with respect to the electrostatic latent image-formed photoreceptor 25 and performing development.

Next, the image forming apparatus 1 sequentially transfers the toner image formed on the photoreceptor 25 to the surface of the intermediate transfer belt 22 by using the primary transfer roller 23 (primary transfer). In the case of a full color image, a toner image in which toner images respectively having the colors of Y, M, C, and K are synthesized is formed on the surface of the intermediate transfer belt 22.

The image forming apparatus 1 removes, with the cleaning device 29, the toner that remains on the photoreceptor 25 without being transferred to the intermediate transfer belt 22.

Subsequently, the image forming apparatus 1 transports the toner image formed on the surface of the intermediate transfer belt 22 to a position facing the secondary transfer roller 24 with the rotating roller 22*a*.

The image forming apparatus 1 feeds a sheet M and guides the sheet M between the intermediate transfer belt 22 and the secondary transfer roller 24 along the transport route TR with a plurality of transport rollers (not illustrated). Then, the image forming apparatus 1 transfers the toner image formed on the surface of the intermediate transfer belt 22 to the sheet M with the secondary transfer roller 24.

The image forming apparatus 1 guides the toner image-transferred sheet M to the fixing device 3 and fixes the toner image on the sheet M with the fixing device 3. Subsequently, the image forming apparatus 1 discharges the toner image-fixed sheet M to the outside of the image forming apparatus 1.

The image forming apparatus 1 further includes a controller 4 (an example of a remover, a bias detector, a determiner, a reference value decider, and a printing rate detector), an environment sensor 51 (an example of an acquirer), and a concentration detector 52.

The controller 4 includes, for example, a central processing unit (CPU) 4*a* controlling the entire image forming apparatus 1 in accordance with a control program, a ROM 4*b* storing the control program, a random access memory (RAM) 4*c* constituting a work area of the CPU 4*a*, and a hard disk drive (HDD) 4*d* storing various types of information.

The environment sensor 51 detects information indicating the environment of the image forming apparatus 1 and outputs the information (here, the information is the temperature and the humidity around the image forming apparatus 1) to the controller 4.

The concentration detector 52 detects the concentration of the toner image formed on the intermediate transfer belt 22 in image stabilization processing (described later) and outputs the concentration to the controller 4.

Figure 2:
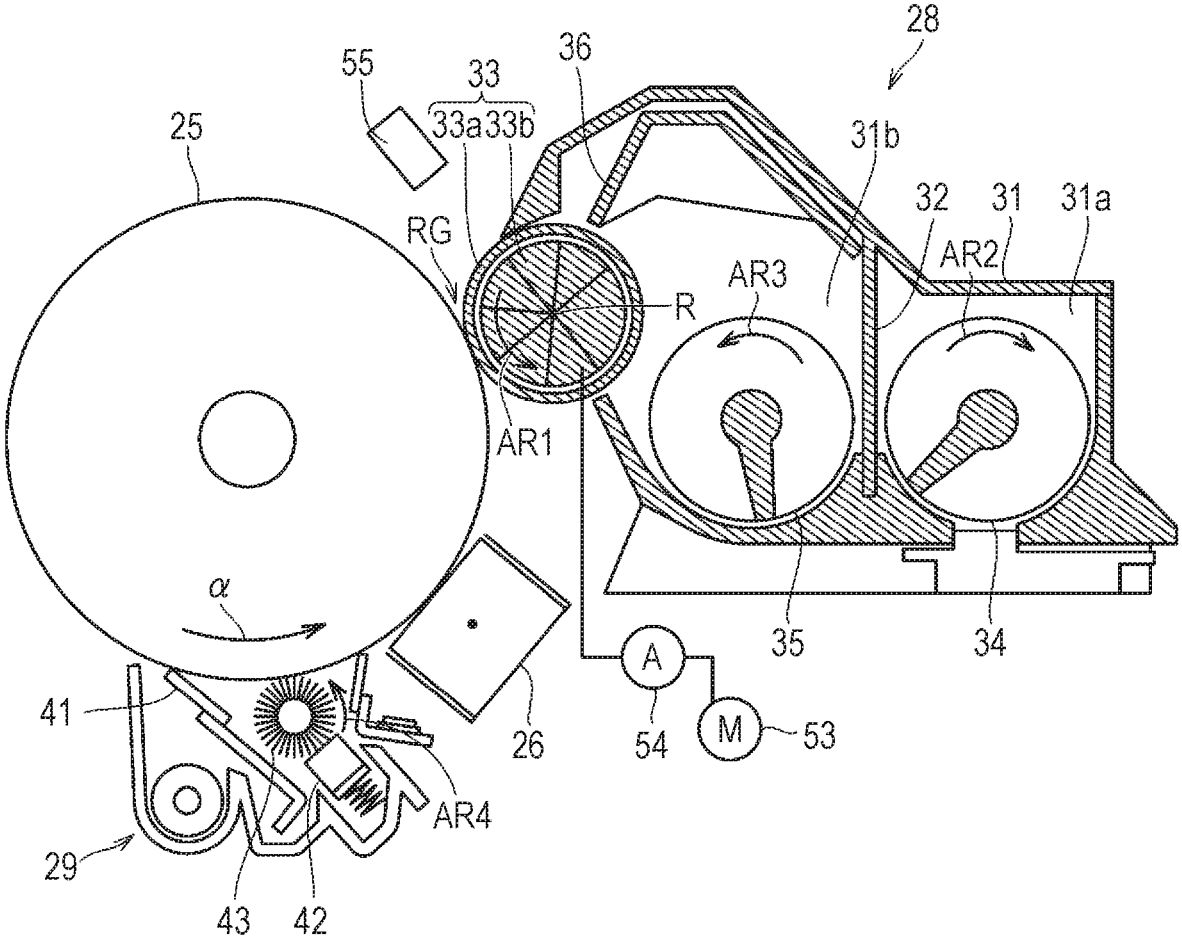
FIG. 2 is an enlarged cross-sectional view illustrating the configuration of a developing device in FIG. 1 and the vicinity of the developing device.

FIG. 2 is an enlarged cross-sectional view illustrating the configuration of the developing device 28 in FIG. 1 and the vicinity of the developing device 28.

Referring to FIG. 2, the developing device 28 develops the electrostatic latent image carried on the photoreceptor 25 with toner. The developing device 28 includes a housing 31 (an example of a casing), a partition wall 32, a developing roller 33, a stirring screw 34, a supply screw 35, and a regulating member 36.

The housing 31 accommodates a developer containing toner and a carrier. The partition wall 32 is provided inside the housing 31. The partition wall 32 partitions the inside of the housing 31 into a stirring tank 31*a* and a supply tank 31*b*. Both the stirring tank 31*a* and the supply tank 31*b* extend along a rotation axis R of a developing sleeve 33*a*.

The developing roller 33 has a cylindrical shape and faces the photoreceptor 25 at a required interval. The developing roller 33 is supported by the housing 31. The developing roller 33 includes the developing sleeve 33*a* and a magnet member 33*b*. The developing sleeve 33*a* supplies the photoreceptor 25 with the toner contained in the developer accommodated in the housing 31. The developing sleeve 33*a* has a cylindrical shape and rotates around the rotation axis R in the direction that is indicated by an arrow AR1. The magnet member 33*b* has a cylindrical shape, and the outer peripheral surface of the magnet member 33*b* is alternately magnetized to the north and south poles along the circumferential direction. The developing roller 33 acquires the developer from the inside of the supply tank 31*b* and guides the acquired developer to a developing region RG facing the photoreceptor 25 with the developing sleeve 33*a* while holding the acquired developer on the outer peripheral surface of the developing sleeve 33*a* with the magnetic force of the magnet member 33*b*.

The regulating member 36 has a plate shape and continuously extends in parallel to the rotation axis R. The regulating member 36 is fixed to the housing 31. The end part of the regulating member 36 that is on the side which is close to the developing roller 33 (end part in a direction perpendicular to the rotation axis R) faces the S pole of the magnet member 33*b* and is spaced apart from the outer peripheral surface of the rotating developing sleeve 33*a*. The regulating member 36 regulates the amount of the toner that is supplied to the photoreceptor 25 (amount of the developer that is transported to the developing region RG) by regulating the region through which the developer held on the outer peripheral surface of the developing sleeve 33*a* passes to the space between the end part and the outer peripheral surface.

The cleaning device 29 includes a cleaning blade 41, a lubricant 42, and an applicator 43. The cleaning blade 41 is in contact with the photoreceptor 25 and recovers the toner that remains on the photoreceptor 25 after the primary transfer. The lubricant 42 is made of zinc stearate or the like. The lubricant 42 is pressed against the applicator 43 by an elastic body such as a spring. The applicator 43 is provided so as to face the photoreceptor 25 on the upstream side of the developing region RG in the rotational direction of the photoreceptor 25. The applicator 43 is made of a brush roller or the like and rotates in the direction that is indicated by an arrow AR4. As a result, the applicator 43 scrapes the surface of the lubricant 42 and applies the lubricant 42 to the photoreceptor 25.

The image forming apparatus 1 further includes a motor 53, an ammeter 54 (an example of a torque detector), and an optical sensor 55 (an example of a glossiness detector). The motor 53 rotationally drives the developing sleeve 33*a*. The ammeter 54 measures the current value that flows to the motor 53 when the developing sleeve 33*a* is driven. The optical sensor 55 irradiates the developing sleeve 33*a* with light and outputs a voltage value corresponding to received reflected light to the controller 4.

[Reasons why Lubricant Mixing into Developing Device Adversely Affects Image Forming Operation]

The inventor of the present application found that lubricant mixing into a developing device adversely affects an image forming operation of an image forming apparatus because of the following reasons.

FIGS. 3A to 3E are diagrams illustrating the reasons why lubricant mixing into a developing device adversely affects an image forming operation of an image forming apparatus.

Figure 3A:
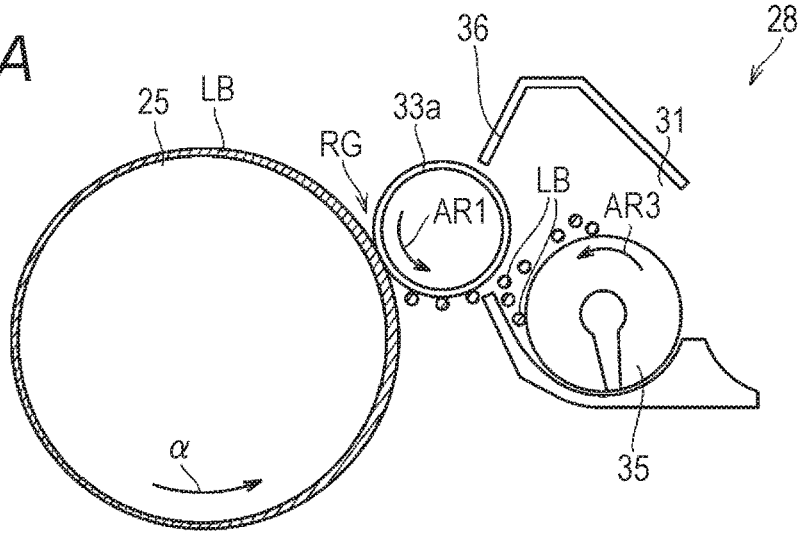
FIGS. 3A to 3E are diagrams illustrating the reasons why lubricant mixing into a developing device adversely affects an image forming operation of an image forming apparatus.

Referring to FIG. 3A, a lubricant LB applied to the surface of the photoreceptor 25 is scraped by the magnetic brush of the developer of the toner formed on the outer peripheral surface of the developing sleeve 33*a* once the lubricant LB comes into contact with the developing sleeve 33*a* in the developing region RG. The scraped lubricant LB intrudes into the housing 31 of the developing device 28 and bonds to the developer. The developer contains a carrier CR and toner T.

Figure 3B:
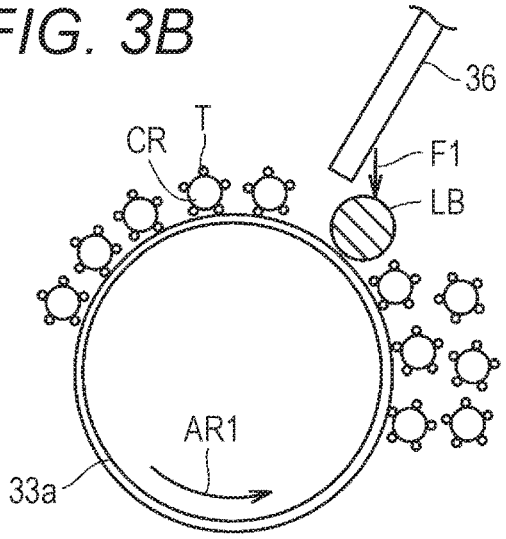
Figure 3C:
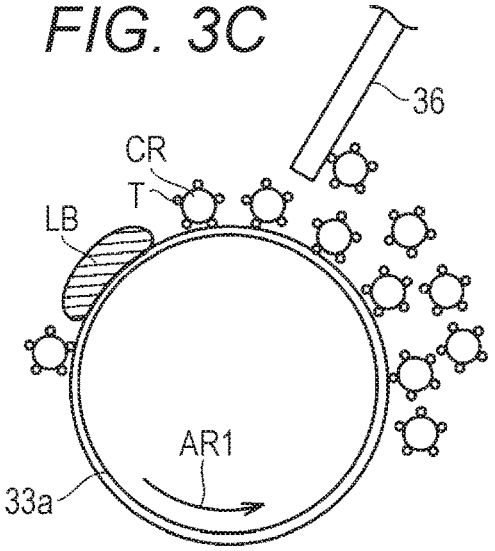

Referring to FIGS. 3B and 3C, the lubricant LB bonded to the developer is supplied to the surface of the developing sleeve 33*a* along with the developer by the magnetic force of the magnet member 33*b*. The lubricant LB receives a pressing force F1 from the regulating member 36 and adheres to the surface of the developing sleeve 33*a*.

Figure 3D:
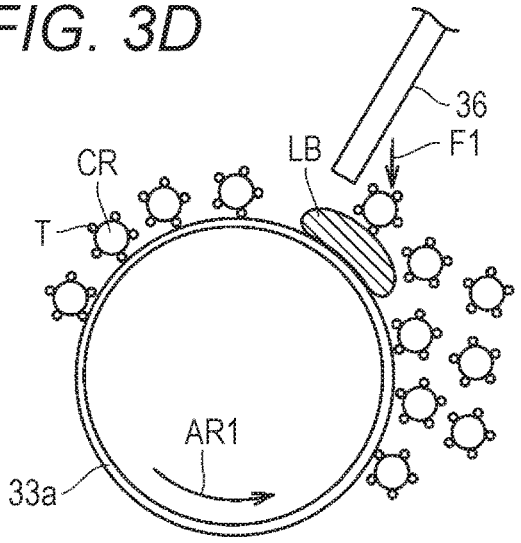
Figure 3E:
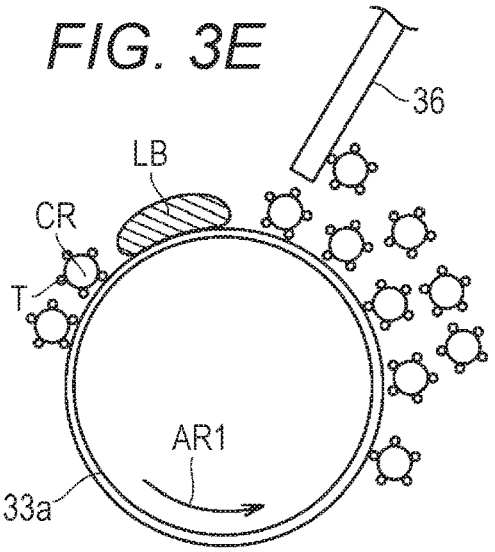

Referring to FIGS. 3D and 3E, the developer passing through the space between the developing sleeve 33*a* and the regulating member 36 receives, from the regulating member 36, the pressing force F1 for pressing against the developing sleeve 33*a*. Once the lubricant LB adheres to the surface of the developing sleeve 33*a* present in the direction of the pressing force F1, the developer slides on the developing sleeve 33*a* because of the lubricant LB and is incapable of adhering to the surface of the developing sleeve 33*a*. As a result, the amount of developer adhesion to the developing sleeve 33*a* decreases, and the developer transport amount of the developing roller 33 decreases.

The amount by which the lubricant LB adheres to the developing sleeve 33*a* and the developer transport amount of the developing sleeve 33*a* are inversely proportional to each other. When the amount by which the lubricant LB adheres onto the developing sleeve 33*a* increases with an increase in the period of use of the developing roller 33, the developer transport amount of the developing sleeve 33*a* falls below the lower limit value of an allowable range, and then the image forming operation is adversely affected.

Figure 4:
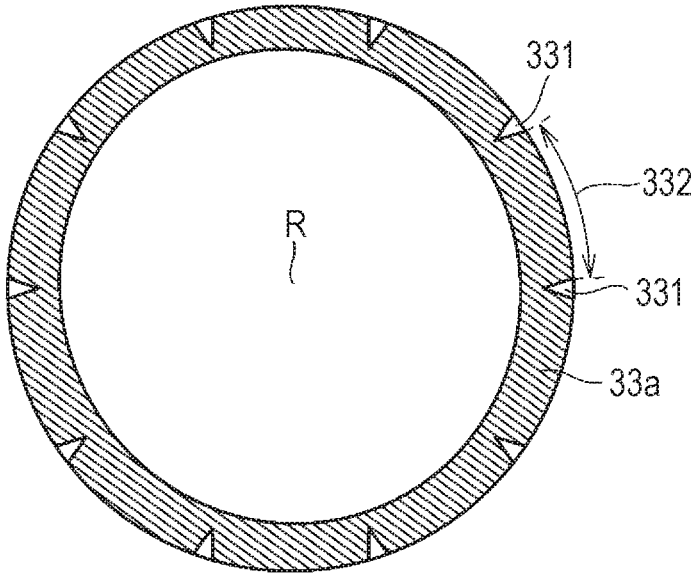
FIG. 4 is a cross-sectional view illustrating another configuration of a developing sleeve according to an embodiment of the present invention.

FIG. 4 is a cross-sectional view illustrating another configuration of the developing sleeve 33*a* according to an embodiment of the present invention.

Referring to FIG. 4, the developing sleeve 33*a* may include a plurality of grooves 331 in the surface of the developing sleeve 33*a*. Each of the plurality of grooves 331 extends along the rotation axis R, and the plurality of grooves 331 are arranged at equal intervals in the circumferential direction. The surfaces of the developing sleeve 33*a* between the plurality of grooves 331 are smooth parts 332. The smooth part 332 has a surface roughness Rz of; for example, 15 μm or less.

In a case where a lubricant adheres to the developing sleeve 33*a* illustrated in FIG. 4, a decrease in developer transport amount particularly conspicuously occurs at the smooth part 332. This is because the developer transport capacity decreases particularly at the smooth part 332 if the lubricant has already adhered to the surface of the developing sleeve 33*a* when the amount of the developer is regulated in the space between the developing sleeve 33*a* and the regulating member 36.

In this regard, the controller 4 detects information indicating the state of lubricant adhesion to the developing sleeve 33*a* and performs a lubricant removing operation based on the result of the detection at any timing as an operation for removing the lubricant adhering on the developing sleeve 33*a*.

[Method for Detecting State of Lubricant Adhesion to Developing Sleeve]

Described below are first to fourth detection methods for detecting the information indicating the state of lubricant adhesion to the developing sleeve 33*a* (adhesion amount in the present embodiment). In the first to fourth detection methods, the necessity of the lubricant removing operation is determined based on a detected value and a reference value. It should be noted that the following first to fourth detection methods can be adopted in appropriate combination. Methods for detecting the information indicating the state of lubricant adhesion to the developing sleeve 33*a* are not limited to the following first to fourth detection methods, and any method may be used.

(1) First Detection Method

Figure 5:
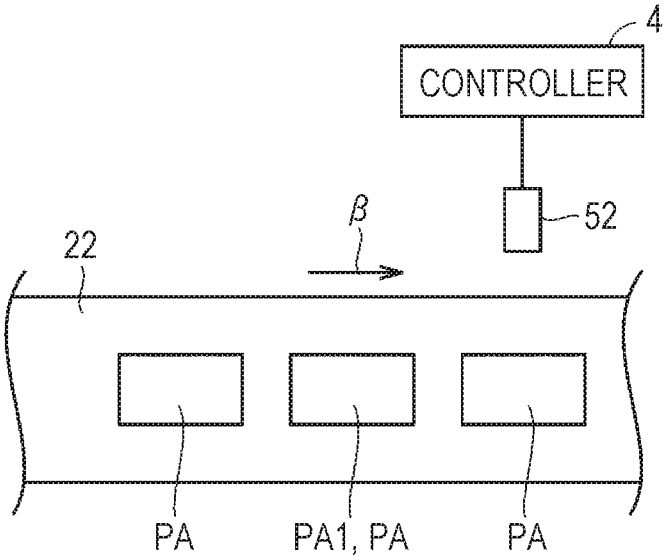
FIG. 5 is a diagram illustrating image stabilization processing performed by the image forming apparatus in an embodiment of the present invention.

FIG. 5 is a diagram illustrating the image stabilization processing performed by the image forming apparatus 1 in an embodiment of the present invention.

Referring to FIG. 5, the controller 4 performs the image stabilization processing at a necessary timing in executing a printing process. Examples of the necessary timing include a power-on timing and a case where the number of printed sheets reaches a predetermined number of sheets. The image stabilization processing is to decide the value of a developing bias suitable for image formation. The developing bias is a voltage applied to the developing sleeve 33*a* during image formation.

The developing bias of the image forming unit 21 for each color is decided in the image stabilization processing. In the case of deciding the developing bias of the image forming unit 21 for a certain color, the controller 4 applies different developing biases to the developing sleeve 33*a* by using the image forming unit 21 for that color and forms a plurality of patches (image having a predetermined pattern) PA on the intermediate transfer belt 22. The controller 4 optically detects the concentration of each of the plurality of patches PA with the concentration detector 52. The controller 4 decides the developing bias used to form a patch PA1, which is a target concentration, as the value of the developing bias suitable for forming the image of that color.

Figure 6:
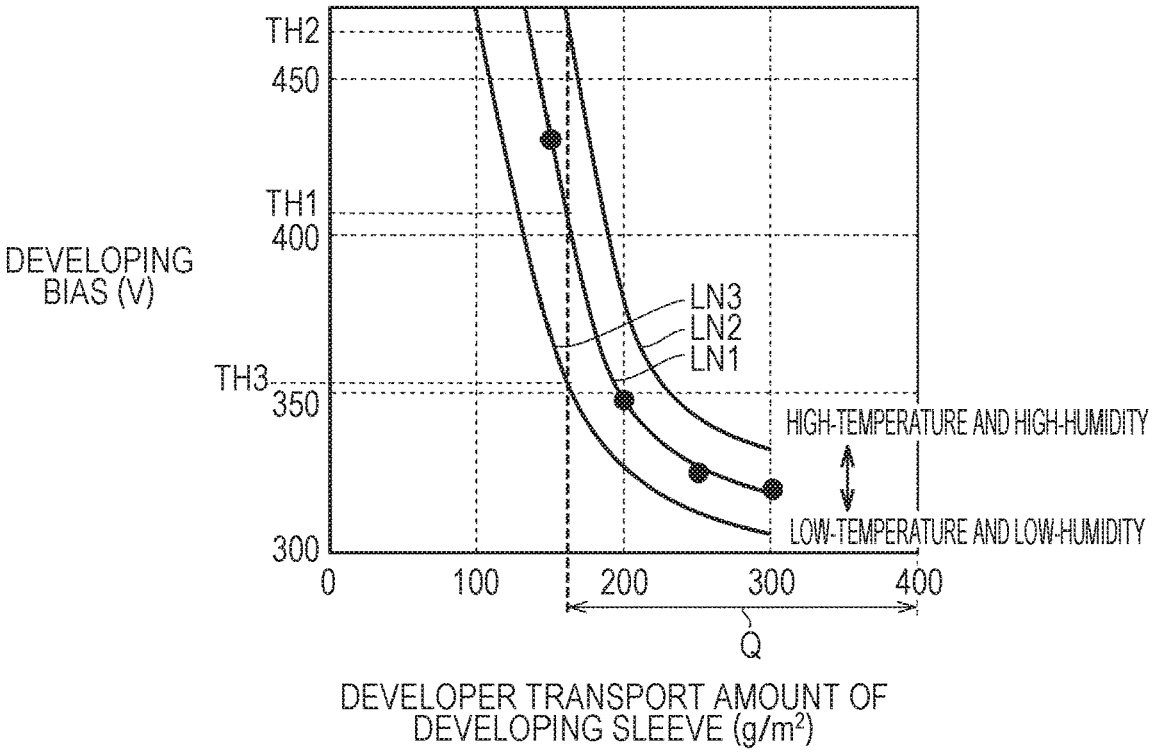
FIG. 6 is a diagram illustrating the relationship between the value of a developing bias decided as a result of the image stabilizing processing and the developer transport amount of the developing sleeve according to an embodiment of the present invention.

FIG. 6 is a diagram illustrating the relationship between the value of the developing bias decided as a result of the image stabilizing processing and the developer transport amount of the developing sleeve 33*a* according to an embodiment of the present invention.

Referring to FIG. 6, the inventor of the present application found that there is a certain relationship between the value of the developing bias decided as a result of the image stabilizing processing and the developer transport amount of the developing sleeve 33*a* and the value of the developing bias decided as a result of the image stabilizing processing indicates the amount of lubricant adhesion to the developing sleeve 33*a*. Specifically, the value of the developing bias decided as a result of the image stabilizing processing and the developer transport amount of the developing sleeve 33*a* have a relationship in which the developing bias value increases as the transport amount decreases as indicated by a line LN1. A range Q is a range in a case where the developer transport amount of the developing sleeve 33*a* is normal (that is, a range in a case where the amount of lubricant adhesion to the developing sleeve 33*a* is normal). Here, the transport amount is 160 g/m$^2$ or more in the range Q.

In this regard, the controller 4 detects the value of the developing bias decided as a result of the image stabilizing processing as the first detection method for detecting the information indicating the state of lubricant adhesion to the developing sleeve 33*a*.

In a case where the first detection method is adopted, the controller 4 sets an upper limit value TH1 of the developing bias at which the transport amount becomes the range Q and determines the necessity of the lubricant removing operation based on the detected developing bias value and the upper limit value TH1. In a case where the detected developing bias value exceeds the upper limit value TH1, the controller 4 determines that the amount of lubricant adhesion to the developing sleeve 33*a* has reached the upper limit value and performs the lubricant removing operation.

The relationship between the detected developing bias value and the developer transport amount of the developing sleeve 33*a* varies with the operation environment of the image forming apparatus 1 (temperature and humidity around the image forming apparatus 1). Specifically, in a case where the environment is a high-temperature and high-humidity environment, the value of the developing bias with respect to the transport amount increases and the relationship between the detected developing bias value and the developer transport amount of the developing sleeve 33*a* becomes the relationship that is indicated by a line LN2. In a case where the environment is a low-temperature and low-humidity environment, the value of the developing bias with respect to the transport amount decreases and the relationship between the detected developing bias value and the developer transport amount of the developing sleeve 33*a* becomes the relationship that is indicated by a line LN3.

In this regard, the controller 4 may acquire the environment-indicating information (temperature and humidity around the image forming apparatus 1) from the environment sensor 51 and set the upper limit value of the developing bias at which the transport amount becomes the range Q based on the acquired information. Specifically, in a case where the environment is a high-temperature and high-humidity environment, the upper limit value of the developing bias at which the transport amount becomes the range Q is set to an upper limit value TH2 by means of the line LN2. In a case where the environment is a low-temperature and low-humidity environment, the upper limit value of the developing bias at which the transport amount becomes the range Q is set to an upper limit value TH3 by means of the line LN3. As a result, it is possible to more accurately obtain the state of lubricant adhesion to the developing sleeve 33*a*.

In a case where the first detection method is adopted, the lines LN1, LN2, and LN3 are pre-calculated by experiment or the like and stored in the HDD 4*d* or the like.

In the first detection method, the controller 4 may detect the developing bias actually applied to the developing sleeve 33*a* instead of the value of the developing bias decided as a result of the image stabilizing processing.

(2) Second Detection Method

Figure 7:
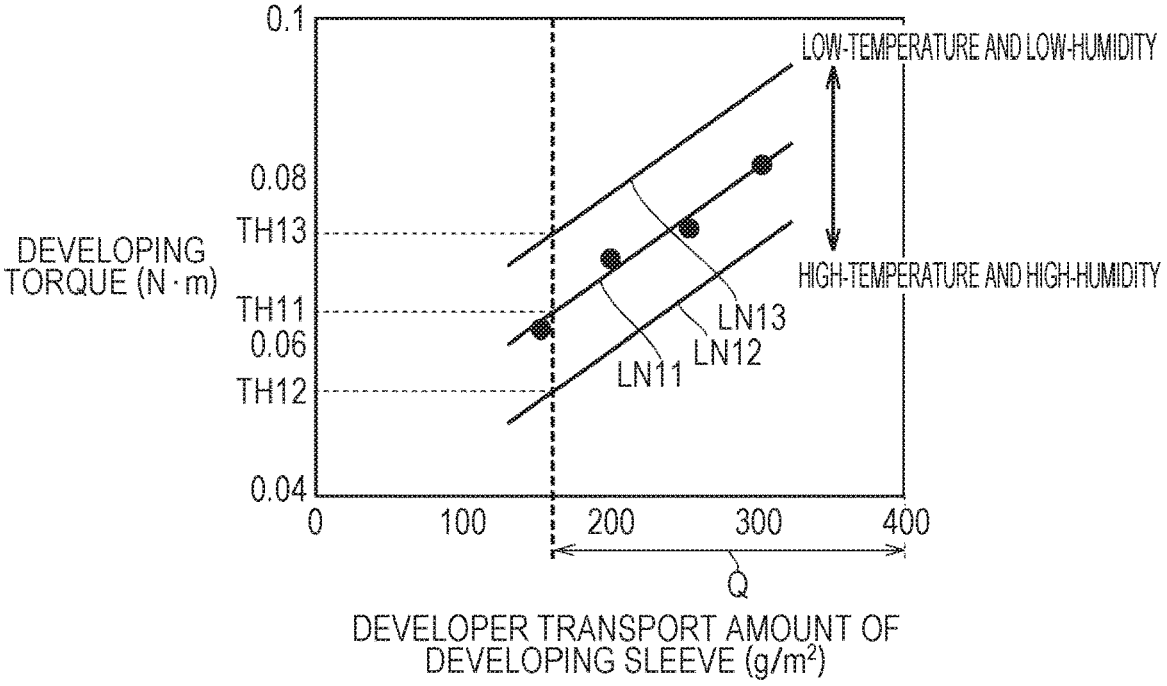
FIG. 7 is a diagram illustrating the relationship between the value of developing torque and the developer transport amount of the developing sleeve according to an embodiment of the present invention.

FIG. 7 is a diagram illustrating the relationship between the value of developing torque and the developer transport amount of the developing sleeve 33*a* according to an embodiment of the present invention.

Referring to FIG. 7, the developing torque is torque required for rotation of the developing sleeve 33*a*. The inventor of the present application found that there is a certain relationship between the value of the developing torque and the developer transport amount of the developing sleeve 33*a* and the value of the developing torque indicates the amount of lubricant adhesion to the developing sleeve 33*a* (adhesion state). Specifically, the developing torque value and the developer transport amount of the developing sleeve 33*a* have a relationship in which the developing torque decreases as the transport amount decreases as indicated by a line LN11.

In this regard, the controller 4 detects a developing torque-indicating value as the second detection method for detecting the information indicating the state of lubricant adhesion to the developing sleeve 33*a*. Adopted here as the developing torque-indicating value is the current value measured by the ammeter 54 (current value flowing to the motor 53 when the developing sleeve 33*a* is driven).

In a case where the second detection method is adopted, the controller 4 sets a lower limit value TH11 of the developing torque at which the transport amount becomes the range Q based on the line LN11 and determines the necessity of the lubricant removing operation based on the detected developing torque value and the lower limit value TH11. In a case where the detected developing torque value is exceeded by the lower limit value TH11, the controller 4 determines that the amount of lubricant adhesion to the developing sleeve 33*a* has reached the upper limit value and performs the lubricant removing operation.

The relationship between the developing torque value and the developer transport amount of the developing sleeve 33*a* varies with the operation environment of the image forming apparatus 1 (temperature and humidity around the image forming apparatus 1). Specifically, in a case where the environment is a high-temperature and high-humidity environment, the value of the developing torque with respect to the transport amount decreases and the relationship between the detected developing torque value and the developer transport amount of the developing sleeve 33*a* becomes the relationship that is indicated by a line LN12. In a case where the environment is a low-temperature and low-humidity environment, the value of the developing torque with respect to the transport amount increases and the relationship between the detected developing torque value and the developer transport amount of the developing sleeve 33*a* becomes the relationship that is indicated by a line LN13.

In this regard, the controller 4 may acquire the information indicating the environment of the image forming apparatus 1 (temperature and humidity around the image forming apparatus 1) from the environment sensor 51 and set the lower limit value of the developing torque at which the transport amount becomes the range Q based on the acquired information. Specifically, in a case where the environment is a high-temperature and high-humidity environment, the lower limit value of the developing torque at which the transport amount becomes the range Q is set to a lower limit value TH12 by means of the line LN12. In a case where the environment is a low-temperature and low-humidity environment, the lower limit value of the developing torque at which the transport amount becomes the range Q is set to a lower limit value TH13 by means of the line LN13. As a result, it is possible to more accurately obtain the state of lubricant adhesion to the developing sleeve 33*a*.

In a case where the second detection method is adopted, the lines LN11, LN12, and LN13 are pre-calculated by experiment or the like and stored in the HDD 4*d* or the like.

(3) Third Detection Method

Figure 8:
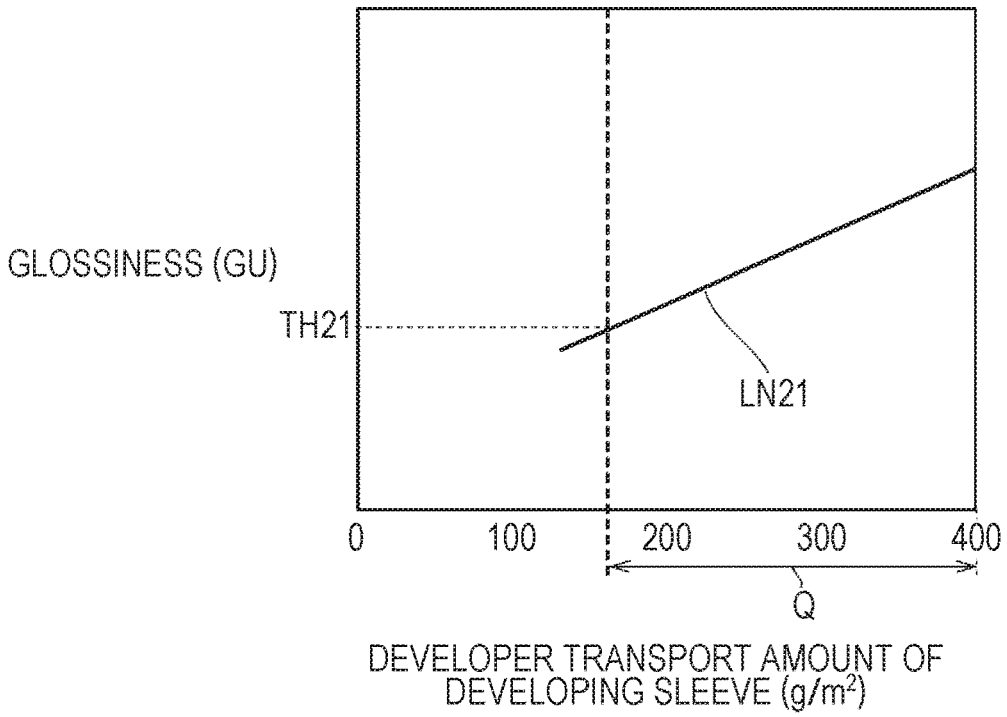
FIG. 8 is a diagram illustrating the relationship between the glossiness of the surface of the developing sleeve and the developer transport amount of the developing sleeve according to an embodiment of the present invention.

FIG. 8 is a diagram illustrating the relationship between the glossiness of the surface of the developing sleeve 33*a* and the developer transport amount of the developing sleeve 33*a* according to an embodiment of the present invention.

Referring to FIG. 8, the inventor of the present application found that there is a certain relationship between the glossiness of the surface of the developing sleeve 33*a* and the developer transport amount of the developing sleeve 33*a* and the glossiness of the surface of the developing sleeve 33*a* indicates the amount of lubricant adhesion to the developing sleeve 33*a* (adhesion state). In a case where the developing sleeve 33*a* is new, the surface of the developing sleeve 33*a* is highly glossy with metallic luster. However, once a lubricant adheres to the developing sleeve 33*a* with an increase in the period of use of the developing sleeve 33*a*, the surface of the developing sleeve 33*a* becomes cloudy and less glossy. As a result, the glossiness of the surface of the developing sleeve 33*a* and the developer transport amount of the developing sleeve 33*a* have a relationship in which the glossiness of the surface of the developing sleeve 33*a* decreases as the transport amount decreases as indicated by a line LN21.

In this regard, the controller 4 detects the glossiness of the surface of the developing sleeve 33*a* based on the voltage value output from the optical sensor 55 as the third detection method for detecting the information indicating the state of lubricant adhesion to the developing sleeve 33*a*.

In a case where the third detection method is adopted, the controller 4 sets a lower limit value TH21 of the glossiness at which the transport amount becomes the range Q based on the line LN21 and determines the necessity of the lubricant removing operation based on the detected glossiness and the lower limit value TH21. In a case where the detected glossiness is exceeded by the lower limit value TH21, the controller 4 determines that the amount of lubricant adhesion to the developing sleeve 33*a* has reached the upper limit value and performs the lubricant removing operation.

In a case where the third detection method is adopted, the line LN21 is pre-calculated by experiment or the like and stored in the HDD 4*d* or the like.

(4) Fourth Detection Method

Figure 9:
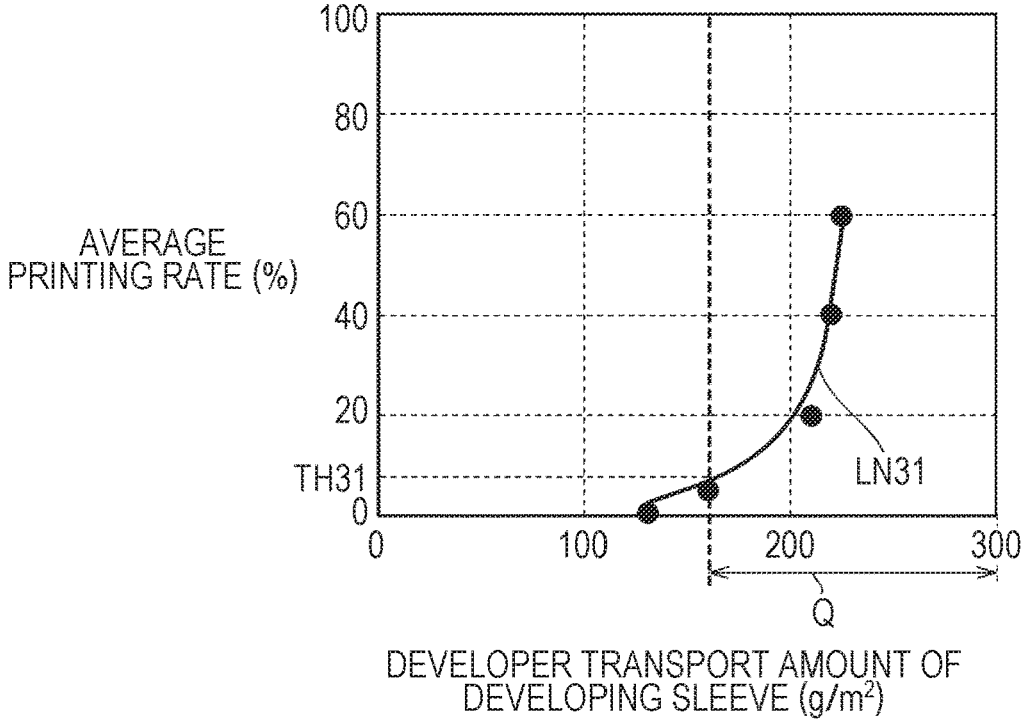
FIG. 9 is a diagram illustrating the relationship between the average printing rate of an image that the image forming apparatus printed in the past and the developer transport amount of the developing sleeve according to an embodiment of the present invention.

FIG. 9 is a diagram illustrating the relationship between the average printing rate of an image that the image forming apparatus 1 printed in the past and the developer transport amount of the developing sleeve 33*a* according to an embodiment of the present invention.

Referring to FIG. 9, the inventor of the present application found that there is a certain relationship between the average printing rate of the image that the image forming apparatus 1 printed in the past (for example, the average printing rate in the case of printing of 25,000 sheets of A4 size images) and the developer transport amount of the developing sleeve 33*a* and the average printing rate of the image that the image forming apparatus 1 printed in the past indicates the amount of lubricant adhesion to the developing sleeve 33*a* (adhesion state). When the average printing rate is low, the amount of the lubricant staying in the housing 31 of the developing device 28 increases, the amount of the lubricant supplied to the developing sleeve 33*a* along with the developer increases, and the amount of lubricant adhesion to the developing sleeve 33*a* increases. As a result, the average printing rate of the image that the image forming apparatus 1 printed in the past and the developer transport amount of the developing sleeve 33*a* have a relationship in which the transport amount decreases as the average printing rate decreases as indicated by a line LN31.

In this regard, the controller 4 calculates and stores the printing rate of a printed image every time printing is performed and detects the average printing rate of the image that the image forming apparatus 1 printed in the past as the fourth detection method for detecting the information indicating the state of lubricant adhesion to the developing sleeve 33*a*.

In a case where the fourth detection method is adopted, the controller 4 sets a lower limit value TH31 of the average printing rate at which the transport amount becomes the range Q based on the line LN31 and determines the necessity of the lubricant removing operation based on the detected average printing rate and the lower limit value TH31. In a case where the detected average printing rate is exceeded by the lower limit value TH31, the controller 4 determines that the amount of lubricant adhesion to the developing sleeve 33*a* has reached the upper limit value and performs the lubricant removing operation.

[Lubricant Removing Operation Performed by Image Forming Apparatus]

Described below is the lubricant removing operation (first and second lubricant removing operations) performed by the image forming apparatus 1. The following first and second lubricant removing operations can be adopted in combination. In addition, the first and second lubricant removing operations may be selectively used in accordance with the amount of lubricant adhesion to the developing sleeve 33*a*. The lubricant removing operation performed by the image forming apparatus 1 is not limited to the following first and second lubricant removing operations and may be any operation.

(1) First Lubricant Removing Operation

Figure 10A:
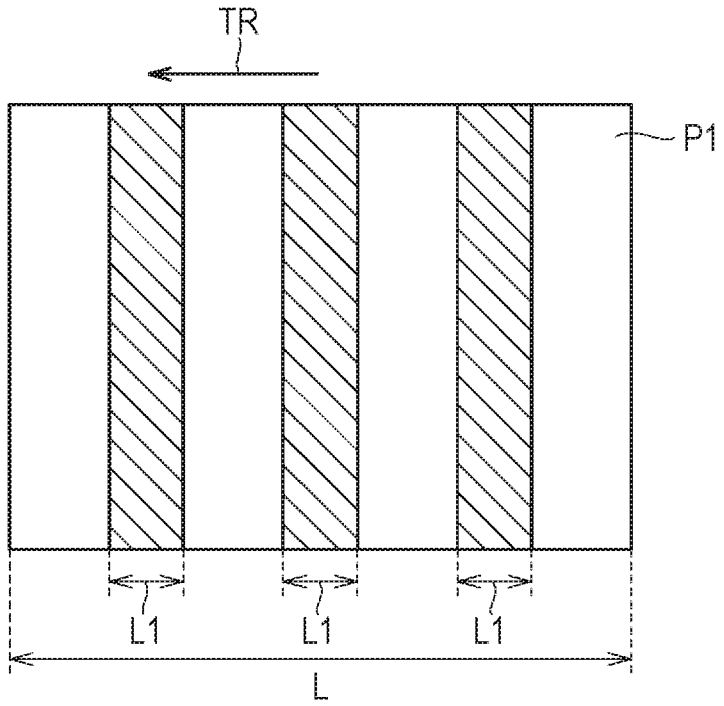
FIGS. 10A and 10B are diagrams schematically illustrating removal images according to an embodiment of the present invention.
Figure 10B:
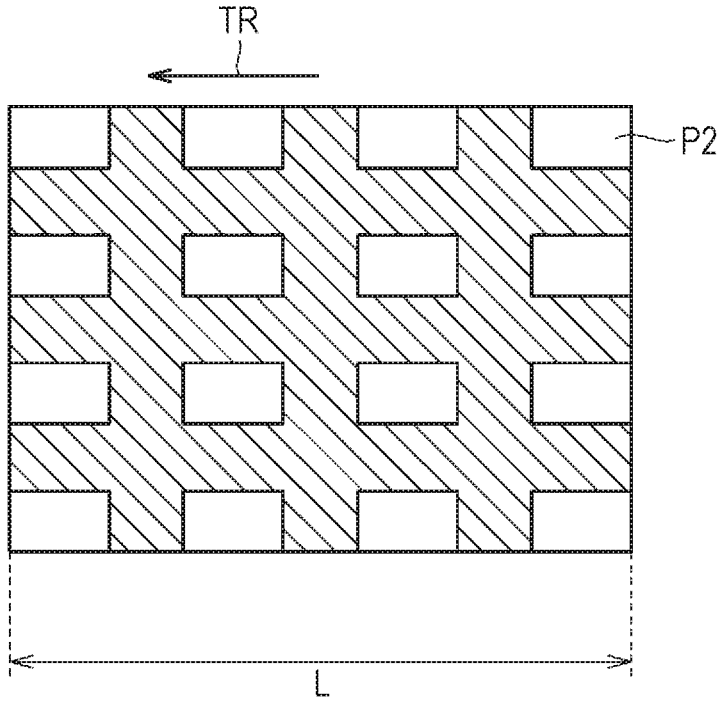

FIGS. 10A and 10B are diagrams schematically illustrating removal images P1 and P2 according to an embodiment of the present invention. FIG. 10A illustrates the removal image P1 as a first example, and FIG. 10B illustrates the removal image P2 as a second example. Printed parts are hatched in FIGS. 10A and 10B.

Referring to FIGS. 10A and 10B, the controller 4 continuously prints the predetermined removal image P1 or P2 on a predetermined number of sheets (for example, 30 A4 size sheets) as the first lubricant removing operation. The removal image P1 is an image (horizontal band chart image) including each of a plurality of lines extending in a direction perpendicular to the transport direction of the sheets (direction of the transport route TR). The removal image P2 is a grid image.

Although any image can be adopted as the removal image, it is preferable that the printing rate of the removal image in the sheet transport direction has a value that is at least as high as a predetermined value (such as 20%) over the entire printing region in the direction perpendicular to the sheet transport direction. The printing rate in the sheet transport direction is the ratio of the total length of a length L1 of the printed part to a length L in the sheet transport direction.

FIGS. 11A to 11D are diagrams illustrating how the lubricant adhering to the developing sleeve 33*a* is removed as a result of the first lubricant removing operation in an embodiment of the present invention.

Figure 11A:
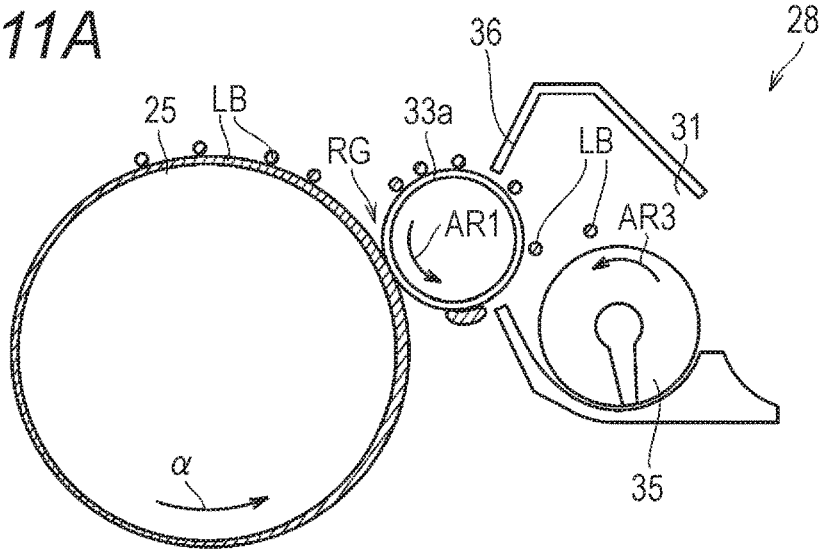
FIGS. 11A to 11D are diagrams illustrating how a lubricant adhering to the developing sleeve is removed as a result of a first lubricant removing operation in an embodiment of the present invention.

Referring to FIG. 11A, once the removal image is continuously printed, the lubricant LB mixed in the housing 31 of the developing device 28 is discharged to the outside of the housing 31 along with the developer used for removal image formation. As a result, the amount of the lubricant LB mixed in the housing 31 decreases.

Figure 11B:
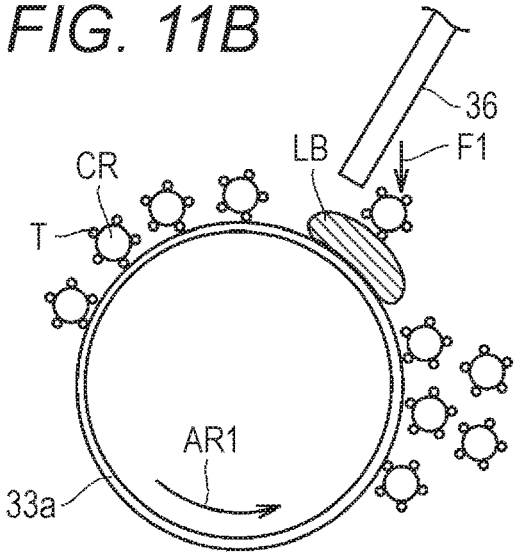

Referring to FIG. 11B, most of the developer supplied to the surface of the developing sleeve 33*a* becomes a developer to which the lubricant LB is not bonded. The developer to which the lubricant LB is not bonded receives the pressing force F1 from the regulating member 36 when passing through the space between the developing sleeve 33*a* and the regulating member 36.

Figure 11C:
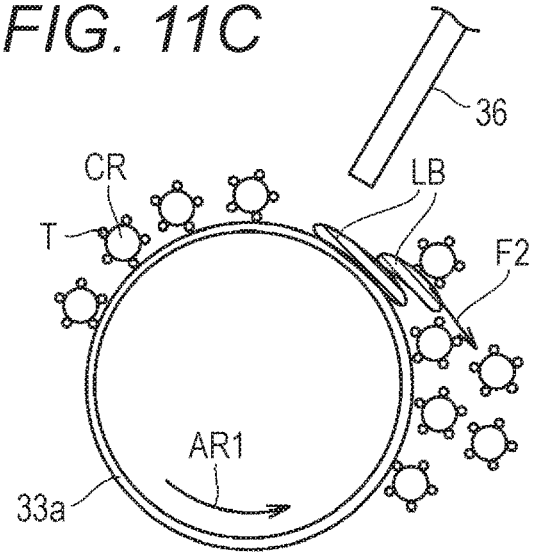

Referring to FIG. 11C, once the lubricant LB adheres to the surface of the developing sleeve 33*a* present in the direction of the pressing force F1, the developer scrapes (scratches) a part of the lubricant LB adhering to the developing sleeve 33*a* while sliding on the developing sleeve 33*a* because of the lubricant LB as indicated by an arrow F2. It is assumed that the relationship between the phenomenon that the lubricant adheres to the developing sleeve 33*a* and the phenomenon that the developer scratches the lubricant adhering to the developing sleeve 33*a* depends on the amount of the lubricant contained in the developer.

Figure 11D:
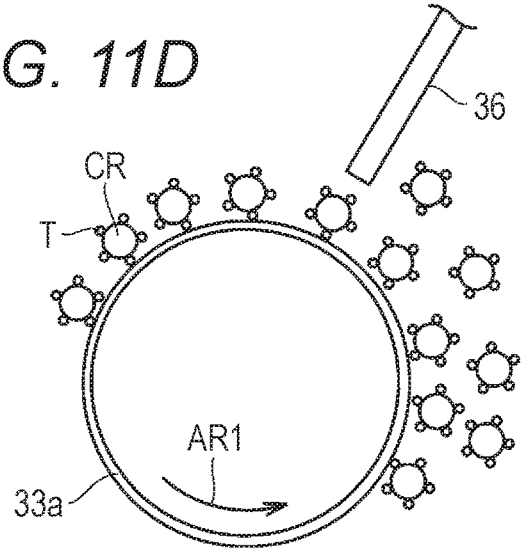

Referring to FIG. 11D, as a result of the scraping of the lubricant LB adhering to the developing sleeve 33*a* by the developer, the amount of the lubricant LB adhering to the developing sleeve 33*a* decreases and the developer transport amount of the developing sleeve 33*a* is restored.

(2) Second Lubricant Removing Operation

Figure 12:
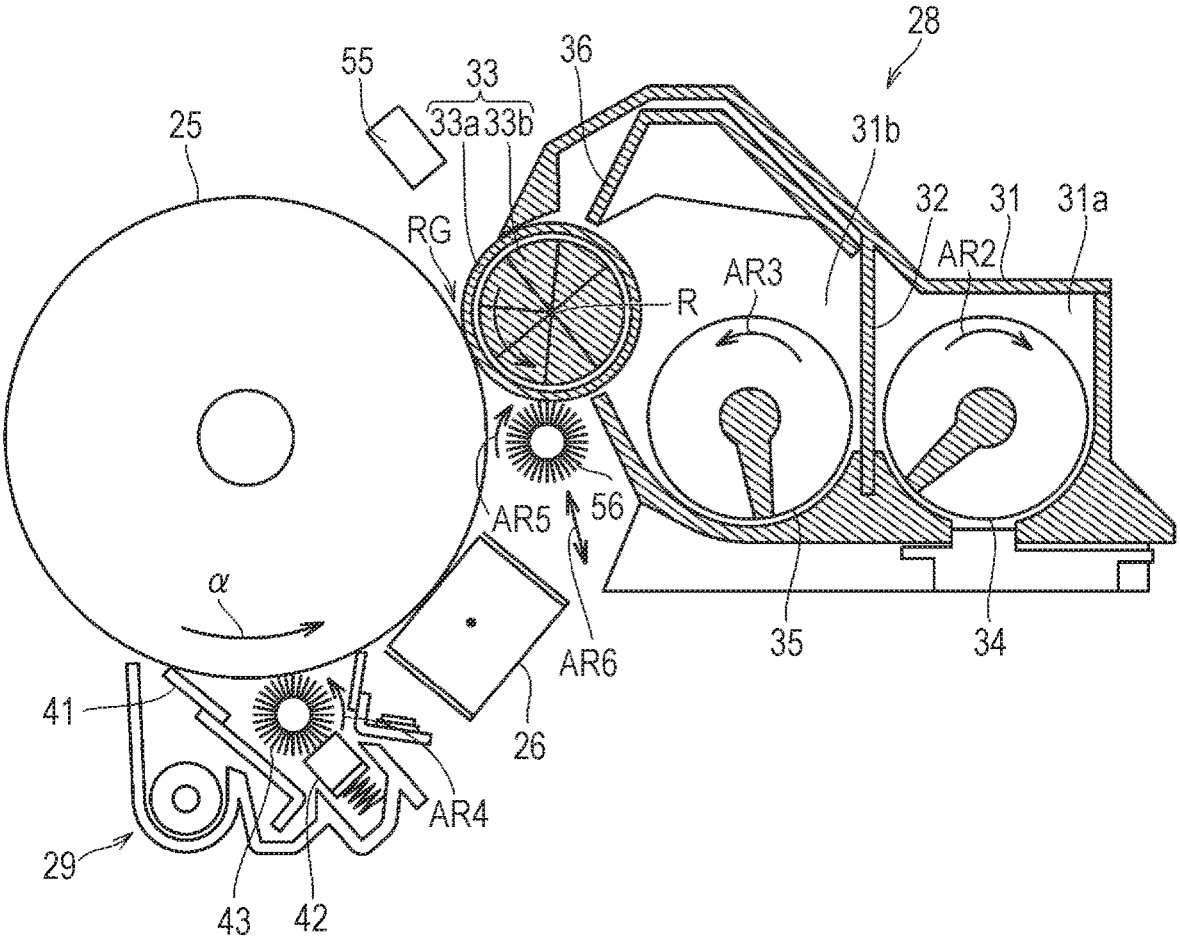
FIG. 12 is an enlarged cross-sectional view illustrating the configuration of the developing device in FIG. 1 and the vicinity of the developing device in a case where a second lubricant removing operation is adopted in an embodiment of the present invention.

FIG. 12 is an enlarged cross-sectional view illustrating the configuration of the developing device 28 in FIG. 1 and the vicinity of the developing device 28 in a case where the second lubricant removing operation is adopted in an embodiment of the present invention. The motor 53 and the ammeter 54 are not illustrated in FIG. 12.

Referring to FIG. 12, the image forming apparatus 1 further includes a lubricant removing member 56 provided so as to face the developing sleeve 33*a*. The controller 4 removes a lubricant by using the lubricant removing member 56 as the second lubricant removing operation. The lubricant removing member 56 has a brush roller shape and rotates in the direction that is indicated by an arrow AR5. The lubricant removing member 56 is movable in the direction that is indicated by an arrow AR6 under the control of the controller 4. As a result, the lubricant removing member 56 is switchable between a contact state where the lubricant is mechanically removed based on contact with the developing sleeve 33*a* and a separated state where the lubricant is not removed without contact with the developing sleeve 33*a*.

The controller 4 switches the lubricant removing member 56 from the separated state to the contact state and rotates the lubricant removing member 56 as the second lubricant removing operation. As a result, the lubricant adhering to the developing sleeve 33*a* is scraped and recovered by the rotating lubricant removing member 56.

[Flowchart]

A flowchart illustrating the operation of the image forming apparatus 1 will be described below.

Figure 13:
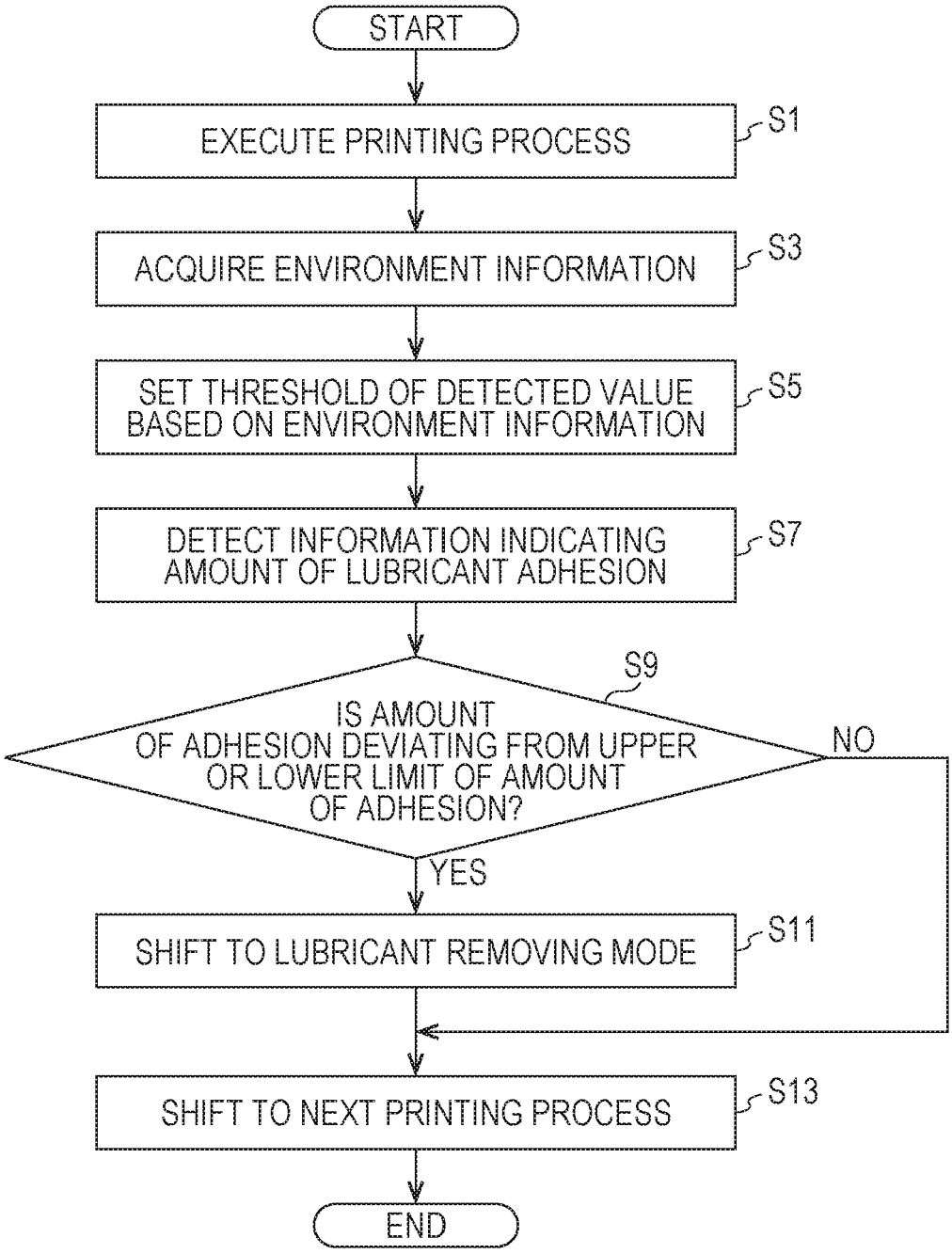
FIG. 13 is a flowchart illustrating an operation of the image forming apparatus according to an embodiment of the present invention.

FIG. 13 is a flowchart illustrating the operation of the image forming apparatus 1 according to an embodiment of the present invention.

Referring to FIG. 13, the controller 4 acquires the environment-indicating information (S3) after executing the printing process (S1). Subsequently, the controller 4 sets a threshold of the detected value (such as the upper limit value of the developing bias and the lower limit value of the developing torque) based on the acquired environment-indicating information (S5). Next, the controller 4 detects the information indicating the amount of lubricant adhesion to the developing sleeve 33*a* (S7) and determines whether or not the detected amount of lubricant adhesion deviates from the upper limit or the lower limit of the adhesion amount (S9).

In a case where it is determined in step S9 that the detected amount of lubricant adhesion deviates from the upper limit or the lower limit of the adhesion amount (YES in S9), the controller 4 shifts to a lubricant removing mode and performs the lubricant removing operation (S11). Next, the controller 4 shifts to the next printing process (S13) and terminates the processing.

In a case where it is determined in step S9 that the detected amount of lubricant adhesion does not deviate from the upper limit or the lower limit of the adhesion amount (NO in S9), the controller 4 shifts to the next printing process without performing the lubricant removing operation (S13) and terminates the processing.

Effect of Embodiment

According to the above embodiment, the information that indicates the state of lubricant adhesion to the developing sleeve 33*a* is detected and the lubricant removing operation is performed based on the result of the detection, and thus an adverse effect on the image forming operation of the image forming apparatus 1 can be effectively deterred.

[Others]

The processing according to the above-described embodiment may be performed by means of software or may be performed by means of a hardware circuit. It is also possible to provide a program for executing the processing according to the above-described embodiment, and a user may be provided with the program recorded on a recording medium such as a CD-ROM, a flexible disk, a hard disk, a ROM, a RAM, and a memory card. The program is executed by a computer such as a CPU. In addition, the program may be downloaded to the apparatus via a communication line such as the Internet.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

an image carrier to which a lubricant is applied;

a developing device that develops an electrostatic latent image carried on the image carrier with toner, and includes a casing to accommodate a toner-containing developer and a developing sleeve to supply the image carrier with the toner contained in the developer accommodated in the casing; and a hardware processor that:

detects a value indicating an amount of lubricant adhesion to the developing sleeve;

determines necessity of a lubricant removing operation based on the value detected by the hardware processor and a reference value; and performs the lubricant removing operation as an operation for removing the lubricant adhering to the developing sleeve, in a case where the hardware processor determines that the lubricant removing operation is necessary, wherein the hardware processor detects a value of a developing bias applied to the developing sleeve.

2. The image forming apparatus according to claim 1, wherein the hardware processor performs image stabilization processing for deciding a developing bias value suitable for image formation and detects the developing bias value decided in the image stabilization processing.

3. The image forming apparatus according to claim 1, wherein the developing device further includes a regulating member that is spaced apart from an outer peripheral surface of the developing sleeve and regulates an amount of the toner supplied to the image carrier by regulating a region through which the developer held on the outer peripheral surface of the developing sleeve passes to a space between the regulating member and the outer peripheral surface.

4. An image forming apparatus comprising:

an image carrier to which a lubricant is applied;

a developing device that develops an electrostatic latent image carried on the image carrier with toner, and includes a casing to accommodate a toner-containing developer and a developing sleeve to supply the image carrier with the toner contained in the developer accommodated in the casing; and a hardware processor that:

detects a value indicating an amount of lubricant adhesion to the developing sleeve;

determines necessity of a lubricant removing operation based on the value detected by the hardware processor and a reference value; and performs the lubricant removing operation as an operation for removing the lubricant adhering to the developing sleeve, in a case where the hardware processor determines that the lubricant removing operation is necessary, wherein the hardware processor includes a torque detector that detects a value indicating torque required for rotation of the developing sleeve.

5. An image forming apparatus comprising:

an image carrier to which a lubricant is applied;

a developing device that develops an electrostatic latent image carried on the image carrier with toner, and includes a casing to accommodate a toner-containing developer and a developing sleeve to supply the image carrier with the toner contained in the developer accommodated in the casing;

a hardware processor that:

detects a value indicating an amount of lubricant adhesion to the developing sleeve;

determines necessity of a lubricant removing operation based on the value detected by the hardware processor and a reference value; and performs the lubricant removing operation as an operation for removing the lubricant adhering to the developing sleeve, in a case where the hardware processor determines that the lubricant removing operation is necessary; and an acquirer that acquires information indicating an environment of the image forming apparatus, wherein the hardware processor decides the reference value based on the information acquired by the acquirer.

6. An image forming apparatus comprising:

an image carrier to which a lubricant is applied;

a developing device that develops an electrostatic latent image carried on the image carrier with toner, and includes a casing to accommodate a toner-containing developer and a developing sleeve to supply the image carrier with the toner contained in the developer accommodated in the casing; and a hardware processor that:

detects a value indicating an amount of lubricant adhesion to the developing sleeve;

determines necessity of a lubricant removing operation based on the value detected by the hardware processor and a reference value; and performs the lubricant removing operation as an operation for removing the lubricant adhering to the developing sleeve, in a case where the hardware processor determines that the lubricant removing operation is necessary, wherein the hardware processor includes a glossiness detector that detects glossiness of the developing sleeve.

7. An image forming apparatus comprising:

an image carrier to which a lubricant is applied;

a developing device that develops an electrostatic latent image carried on the image carrier with toner, and includes a casing to accommodate a toner-containing developer and a developing sleeve to supply the image carrier with the toner contained in the developer accommodated in the casing; and a hardware processor that detects information indicating a state of lubricant adhesion to the developing sleeve, and performs, based on a result of the detection by the hardware processor, a lubricant removing operation as an operation for removing the lubricant adhering to the developing sleeve, wherein the hardware processor prints a removal image on a sheet as the lubricant removing operation.

8. The image forming apparatus according to claim 7, wherein a printing rate of the removal image in a sheet transport direction is a predetermined value or more over an entire printing region in a direction perpendicular to the sheet transport direction.

9. The image forming apparatus according to claim 7, wherein the removal image is an image including each of a plurality of lines extending in a direction perpendicular to a sheet transport direction or a grid image.

10. An image forming apparatus comprising:

an image carrier to which a lubricant is applied;

a developing device that develops an electrostatic latent image carried on the image carrier with toner, and includes a casing to accommodate a toner-containing developer and a developing sleeve to supply the image carrier with the toner contained in the developer accommodated in the casing;

a hardware processor that detects information indicating a state of lubricant adhesion to the developing sleeve, and performs, based on a result of the detection by the hardware processor, a lubricant removing operation as an operation for removing the lubricant adhering to the developing sleeve; and a lubricant removing member that mechanically removes the lubricant adhering to the developing sleeve, wherein the hardware processor removes the lubricant by using the lubricant removing member as the lubricant removing operation.

11. The image forming apparatus according to claim 10, wherein:

the lubricant removing member has a brush roller shape and is switchable between a contact state where the lubricant removing member removes the lubricant based on contact with the developing sleeve and a separated state where the lubricant removing member does not remove the lubricant without contact with the developing sleeve, and the hardware processor switches the lubricant removing member from the separated state to the contact state as the lubricant removing operation.

* * * * *